United States Patent [19]

Hahn

[11] Patent Number: 4,727,663

[45] Date of Patent: Mar. 1, 1988

[54] EXCAVATING TOOTH HAVING A LOCK INCLUDING A BASKET SPRING

[75] Inventor: Frederick C. Hahn, Aloha, Oreg.

[73] Assignee: Esco Corporation, Portland, Oreg.

[21] Appl. No.: 791,117

[22] Filed: Oct. 24, 1985

[51] Int. Cl.[4] ..... E02F 9/28

[52] U.S. Cl. ..... 37/142 A; 411/508

[58] Field of Search ..... 37/142 A, 142 R; 299/92; 403/155, 154, 378, 379; 411/481, 512, 514, 519, 516, 508–510

[56] References Cited

U.S. PATENT DOCUMENTS

| | | | |
|---|---|---|---|
| 2,483,032 | 9/1949 | Baer | 37/142 A |
| 2,846,790 | 8/1958 | Davis | 37/142 A |
| 2,860,861 | 11/1958 | Larson | 37/142 R X |
| 2,919,506 | 1/1960 | Larsen | 37/142 A |
| 2,994,141 | 8/1961 | Stephenson | 37/142 R |
| 3,012,345 | 12/1961 | Larsen | 37/142 A |
| 3,079,710 | 3/1963 | Larsen et al. | 37/142 R |
| 3,106,256 | 10/1963 | McBride | 37/142 A X |
| 3,126,654 | 3/1964 | Eyolfson | 37/142 A |
| 3,767,266 | 10/1973 | Krekeler | 37/142 A X |
| 3,832,977 | 8/1974 | Von Mehren | 37/142 A X |
| 3,999,614 | 12/1976 | Rhoads | 37/142 R X |
| 4,061,432 | 12/1977 | Hahn et al. | 37/142 R X |
| 4,136,469 | 1/1979 | Zepf | 37/142 R X |
| 4,231,173 | 11/1980 | Davis | 37/142 R |
| 4,317,300 | 3/1982 | Emrich et al. | 37/142 R |
| 4,326,348 | 4/1982 | Emrich | 37/142 R |
| 4,428,131 | 1/1984 | Hahn | 37/142 R |

*Primary Examiner*—Clifford D. Crowder

*Attorney, Agent, or Firm*—Tilton, Fallon, Lungmus & Chestnut

[57] ABSTRACT

A locking device for an excavating tooth, where the tooth has vertically aligned openings for the receipt of the locking device, which includes a relatively elongated pin having a reduced diameter central cylindrical portion and a basket spring mounted and substantially surrounding the cylindrical portion to provide a ball and socket-like connection between the lock and the tooth.

5 Claims, 10 Drawing Figures

11
12
13
14
15
16
17
18
19
20
21
22
23
24
25
28
28a
37
38

22
32
33
34

12
13
14
14a
14b
16
17
18
20
20'
22
23
24
25
36
38
R 17
18
36

EXCAVATING TOOTH HAVING A LOCK INCLUDING A BASKET SPRING

FIELD OF INVENTION, BACKGROUND AND PRIOR ART

This invention relates to an excavating tooth and more particularly to one which employs a basket-type spring in combination with a vertical pin to constitute the lock between the point and the adapter.

SUMMARY OF INVENTION

One of the earliest commercial two-piece locks was that shown in U.S. Pat. No. 2,483,032. There will be seen that the lock consisted of the tapered pin and a rubber plug serving as a keeper. This permitted the point to be removed from the adapter but the disassembly of the lock was difficult, requiring the application of a force from below. A commercial version of the keeper or rubber lock portion for the tooth of the '032 patent is seen in U.S. Pat. No. 2,846,790.

Subsequently it was found that the previous locks were incapable of maintaining their position within the aligned opening and a subsequent commercial version of the tooth employed the construction scene in U.S. Pat. No. 2,919,506. There it is seen that the lock included a number of corrugations or projections on the keeper for engagement with the tapered pin. This principle was refined in U.S. Pat. No. 3,126,654 where the multiple engagement was utilized but with a reversible style pin--one that could be both installed and removed by a force exerted at the top. This type of construction worked well for years but with the greater forces encountered by excavating teeth, it was found that, notwithstanding the multiple projection engagement, the pins could still be ejected.

This resulted in a reconstruction of the point and adapter as seen in U.S. Pat. No. 4,231,173. This has worked well in practice for certain types of excavating teeth, but not particularly for the digger teeth employed in arduous mining operations. These teeth, often installed on a dragline bucket, are relatively wide and short and historically have utilized the side installed pin locks. (See U.S. Pat. Nos. 4,326,348 and 4,428,131.) Where the nose of the adapter is relatively short, as in a mining tooth, the previously available vertical locks were considered inadequate.

However, the invention has resolved this problem through the use of a unique lock, particularly in the form of the keeper or resilient member, which is provided in the form of a basket spring, i.e., a spring which has a central portion which is essentially a double truncated ellipsoid--in contrast to the spring keeper of U.S. Pat. No. 3,832,077.

According to the invention, a vertical pin is employed but now, for the first time, without the usual deprecating shear at the inside surface of the point. This is achieved through the use of the basket spring, and results in increasing the strength of the adapter nose point and pin while allowing vertical drivethrough capability.

The invention is described in conjunction with the accompanying drawing, in which FIG. 1 is a sectional view, in fragmentary form, of an excavating or digger tooth constructed according to the teachings of the instant invention;

DETAILED DESCRIPTION

Figure 1:
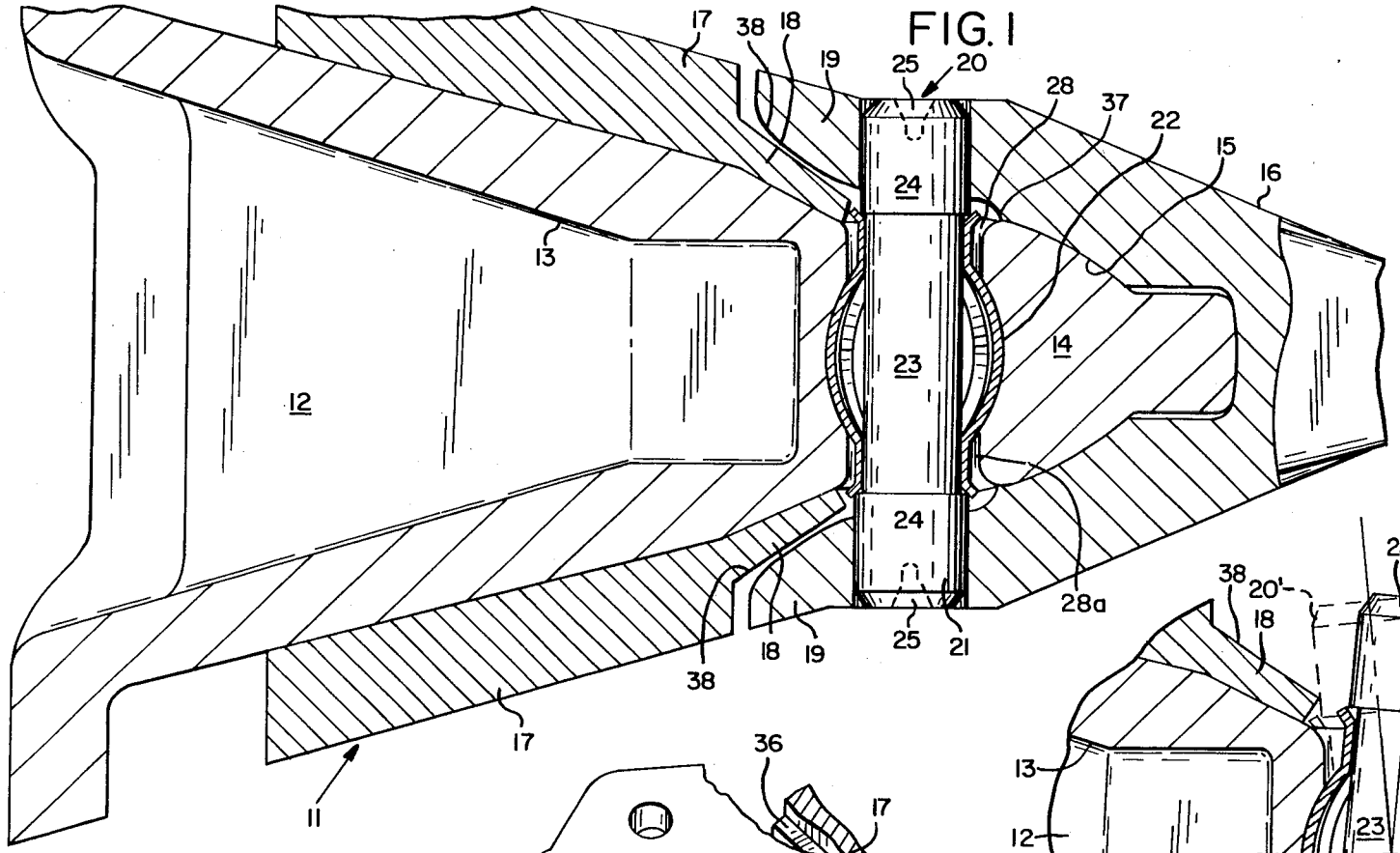
Figure 5:
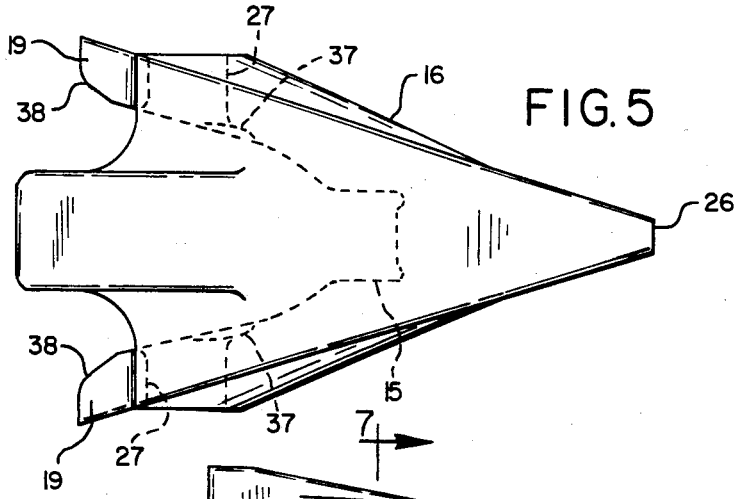
FIG. 5 is a side elevational view of the tooth point employed in the practice of the invention.

In the illustrations given and with reference first to FIG. 1, the numeral 11 designates generally an excavating tooth which is seen in longitudinal section. The tooth 11 includes an adapter 12 which is normally installed on the forward edge or lip of an excavating machine, viz., drag line bucket, shovel dipper, etc. The adapter has a socket providing portion 13 which fits over the bucket lip and a nose portion 14 which is arranged to be received within the socket 15 (see FIG. 5) of an excavating tooth point 16.

In the illustration given, the adapter is equipped with upper and lower wear caps as at 17, which serve to protect the upper and lower surfaces of the adapter against wear or abrasion from passage of excavated material therepast. The wear caps 17 are identical and thus are interchangeable. The wear cap 17 is equipped with a forwardly-extending tang as at 18 which fits under a portion of the upper and lower rearwardly-extending walls 19 of the point 16. Thus the point 16, in the first instance, serves to retain the wear caps in place on the adapter 12.

The numeral 20 designates generally the locking mechanism which removably secures the point 16 on the adapter 12—more particularly, the adapter nose 14. The lock mechanism 20 includes a vertically-extending pin 21 and a basket, spring 22—the latter seen in perspective view in FIG. 2.

First focusing on the pin 21, it will be seen that this is a unitary element of rather elongated nature and has a reduced diameter central portion 23. This results in larger end portions as at 24—still referring to FIG. 1. Provided at each end of the pin 21 are countersunk openings 25 so that a pointed removal tool or drift pin can be used for easy removal and installation. Through the use of the countersunk openings or holes 25, it is ensured that every pound of removal energy is directed into pure thrust down the axis of the pin, thus eliminating any waste forces, and at the same time providing the solid indentation to receive the removal tool, thus providing a safety advantage.

Figure 6:
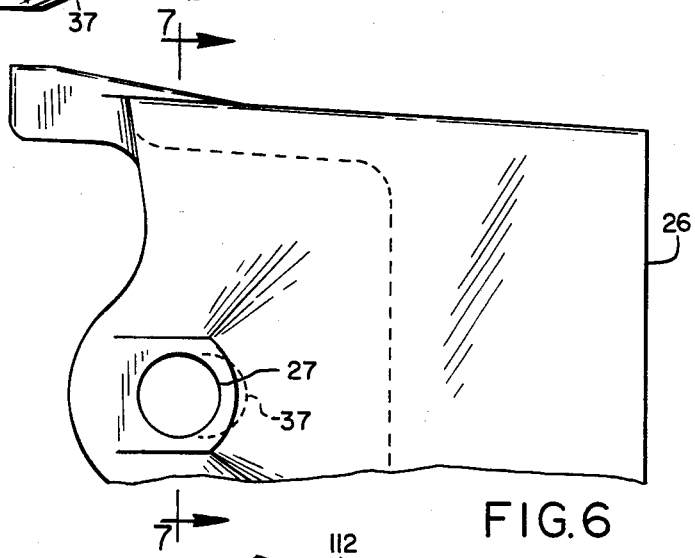
FIG. 6 is a fragmentary top plan view of the point of FIG. 5.

As one example of the practice of the invention, and in connection with a typical tooth point 16 which weighs approximately 43 pounds and which has a horizontal dimension across the tip 26 (see FIGS. 5 and 6) of approximately 8 inches, the pin 21 has a length of 5.32 inches with the length of the reduced diameter central portion being 3.08 inches. The diameter of the end portions 24 is 1.12 inches and that of the reduced central portion 23, 1.03 inches.

The pin 21 extends through upper and lower openings 27 (see FIGS. 5 and 6) in the upper and lower walls 19 of the point 16. It will be appreciated from a consideration of FIG. 5 that the point 16 is reversible—either side can be positioned upwardly or downwardly as wear patterns develop.

Figure 8:
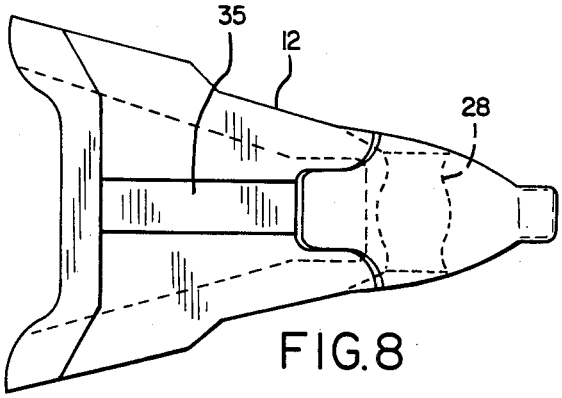
FIG. 8 is a side elevational view of the adapter employed in the practice of the invention according to the FIG. 1 embodiment.
Figure 9:
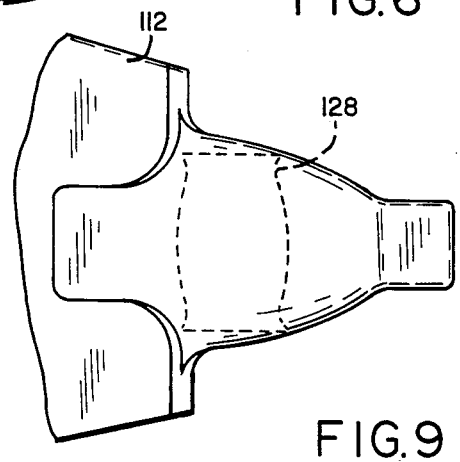
FIG. 9 is a fragmentary side elevational view of another adapter nose which can be used to advantage in the practice of the invention and which differs from that of FIG. 8 in not being arranged for the receipt of wear caps.

The pin also extends through a vertically-extending opening or passage 28 (see FIG. 1) in the adapter nose 14. The passage 28 can also be seen in the adapter 12 as depicted in FIG. 8 and also at 128 in the version of the adapter 112 seen in FIG. 9.

The passage 28 or 128, as the case may be, is contoured so as to receive the basket spring 22. In other words, the passage 28 is radially enlarged so as to conform to the shape of the ellipsoidal shape of the basket spring 22. In effect, the spring central portion has the shape of a double-truncated ellipsoid.

Figure 10:
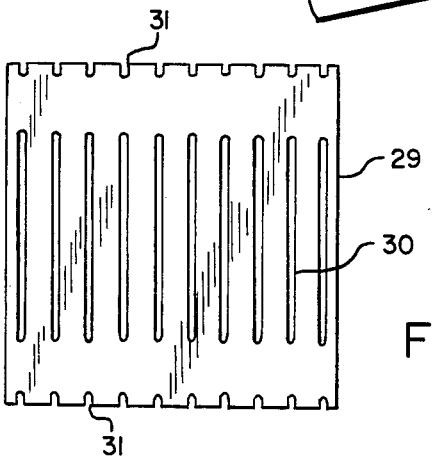
FIG. 10 is an elevational view of a blank employed to make the basket spring of FIG. 2.

The basket spring 22 in the example given above relative to an approximately 8-inch-wide point is developed from a blank 29 such as is seen in FIG. 10. The blank 29 has a height of 3.47 inches and a width of 3.35 inches. The slots 30 have a length of 1.95 inches and a width of 0.03 inches, being spaced apart on 0.347 inch centers. The notches 31 at the top and bottom are aligned with the slots and have the same width but with a depth of 0.18 inches.

Figure 2:
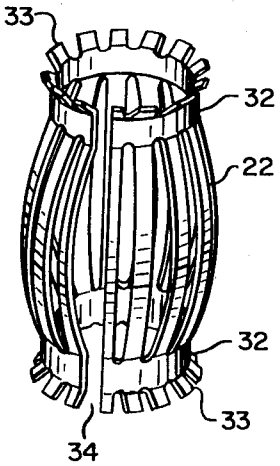
FIG. 2 is a perspective view of the basket spring employed as part of the tooth lock.

The blank 29 is deformed to the configuration seen in FIG. 2, at which time the height is 3.25 inches. The bowing or bulging—to the ellipsoidal shape—is achieved all within the length of the slots 30 as can be appreciated from a consideration of FIG. 2. This then results in cylindrical collars top and bottom, as at 32, which have a height of 0.58 inches, i.e., the distance between the tops, for example, of the slots 30 and the bottoms of the upper notches 31. The portion of the blank occupied by the notches 31 is flared outwardly at an angle of about 45° to provide end flanges as at 33. Both when relaxed as in FIG. 2 and when installed as in FIG. 1, the basket spring 22 has a circumference slightly less than that provided within the passageway 28 so that a longitudinally-extending gap 34 exists in the circumference of the basket spring 22.

Figure 3:
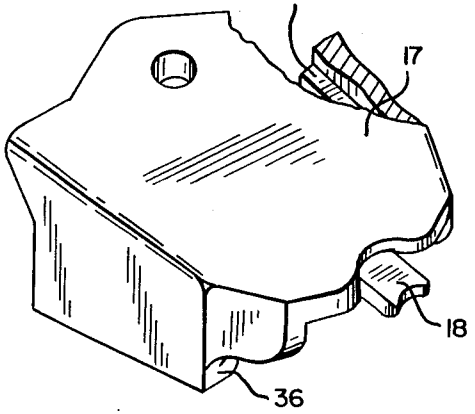
FIG. 3 is a perspective view of a wear cap which may be advantageously employed with the inventive locking device, the view being partially broken away to show side rails on the wear cap for mounting on the adapter.

In operation, the invented tooth provides a single vertical pin rather than two sidelocked pins as in U.S. Pat. Nos. 4,326,348 and 4,428,131. The pin 21 is secured by the basket spring 22 which works like a ball joint to take the shear loads (which normally cause failure of vertical pins) off the pin, retain the pin from premature ejection, and act as a backup lock to prevent loss of the wear caps in the event the point 16 falls off. It will be appreciated that under sharp impact loads, a point 16 may be shattered or fragmented, at which time there would normally be nothing to prevent loss of wear caps. These are not insignificant items, since, in the example given of an 8-inch approximately 43-pound point each wear cap weighs approximately 28 pounds. Also, for the same size point as given in the example, the adapter weighs about 78 pounds, the essential difference between the adapters 12 and 112 of FIGS. 8 and 9, respectively, resides in the provision in the adapter 12 of horizontal slots or ways 35 in the side walls which receive the rails 36 (see FIG. 3) of the wear caps 17, similar to these in U.S. Pat. Nos. 4,326,348 and 4,428,131.

Figure 4:
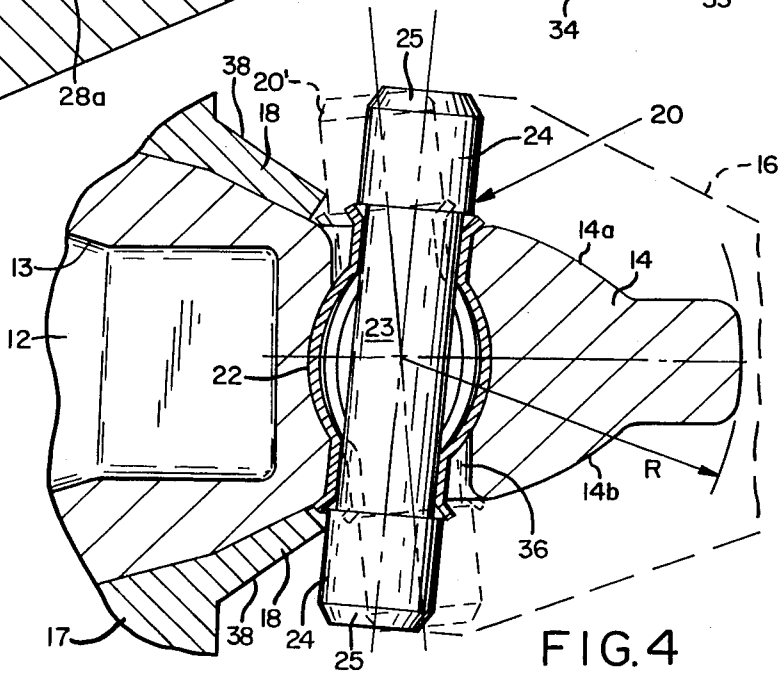
FIG. 4 is a fragmentary sectional view of the adapter nose and associated wear caps showing the type of movement possible through the use of the lock employed in the instant invention.

Turning now to FIG. 4, the ball joint action of the locking mechanism 23 is illustrated. For ease of understanding and clarity of presentation, the point 16 has been omitted from the adapter nose 14. However, the point, being the penetrating implement, receives the beam loads and tends to move in a vertical arc, the direction of which is determined by the direction of the beam loads, such as upwardly or downwardly. This causes the locking mechanism 20 to move accordingly. For example, in FIG. 4, the solid line showing is a condition the locking mechanism could assume upon a heavy downward beam load, whereas the dotted line showing as at 20' would be the position of the locking mechanism upon an upward beam load being applied to the excavating tooth point.

More particularly, the point moves as result of ball joint action vertically about the butt fit forward area of the nose 14, which advantageously is radiused from the axial center of the passageway 28, viz., the intersection of the nose center line with the axis of passageway 28. Also, the point moves in a rolling fashion about the radiused surfaces on the nose sloping upper and lower faces, as at **14*a* and 14*b***.

Figure 7:
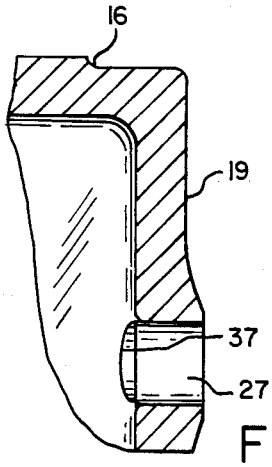
FIG. 7 is a fragmentary sectional view taken along the sight line 7—7 of FIG. 6.

To accommodate this rolling or ball joint action, I have enlarged the upper and lower portions of the passage 28 as at **28*a*—see the lower central portion of FIG. 1. Also, I have enlarged the socket 15 of the tooth point 16 as at 37 to accommodate this action and, more particularly, the flanges 33 of the basket spring 22. This extra relief is provided in the upper and lower walls 19 in the portion defining the socket 15 and on the forward side of the passage 27—see particularly FIGS. 6 and 7. Thus, I have specially adapted the interior of the point 16 to accommodate the advantageous ball joint action illustrated in FIG. 4. It will be appreciated that the recesses 37 do accommodate the flanges 33 but it is to be understood that the flanges not only seat or project into the recesses 37** but more particularly move with the pin and point in a unitary assembly during the above-mentioned ball joint action.

The interior or socket portion of the point 16 is also arranged so as to confine the tangs 18 of the wear caps 17. This can be appreciated from the sloping surfaces 38 provided on the inside of the upper and lower walls 19 of the point 16.

Through this arrangement and, more particularly, the basket spring, there is at least a temporary assurance that the wear caps will not fall off after the loss of the point and also on occasion, the pin—but the wear caps will normally operate long enough for the operator or maintenance people to notice the point loss and replace it before the wear caps fall off. This might be involved at shift change or during maintenance, so four to eight hours would be possible.

To the best of my knowledge, a basket type spring has never been created for any application, much less for one in the excavating art. Its application provides a much easier and safer installation and removal system over the conventional, which uses the "knuckle-busting" side lock pins.

In operation, the preferred embodiment of the basket spring 22 involves flared ends and a swollen, radiused center. The former acts to keep the spring from going into the pin hole in the point 16 and to retain the wear caps when the point breaks off, and the latter—the radiused central portion—provides the ball point action and spring take-up to hold the point on the adapter nose. The vertical locking pin 21 has a recessed portion intermediate its length to accept the spring, thus providing stops at each end and under the bearing area in the point so that the pin is retained within the basket spring.

While in the foregoing specification a detailed description of the invention has been set down for the purpose of exclamation, many variations of the details herein given may be made by those skilled in the art without departing from the spirit and scope of the invention.

I claim:

1. A lock for an excavating tooth and the like comprising a relatively elongated pin having a reduced diameter central cylindrical portion and a basket spring mounted on and substantially surrounding said cylindrical portion between said lock and tooth, said basket spring including a relatively elongated unitary member having a central part diametrically enlarged relative to the spring end parts, said central part including a plurality of longitudinally extending slots, said basket spring end parts including angularly flanged slotted ends spaced from said longitudinally extending slots of said central part.

2. An excavating tooth comprising and adapter having a nose, a point removably mounted on said nose, vertically aligned lock openings in said point of said nose, said nose opening having generally the shape of a double truncated ellipsoid, and a lock removably mounted in said aligned openings, said lock including a relatively elongated pin having diametrically enlarged end portions and a diametrically reduced central portion, and a double truncated generally ellipsoidal split spring mounted on said pin central portion and in said nose opening.

3. The tooth of claim 2 including a wear cap equipped with a forwardly projecting tang adapted to engage a pin end portion.

4. The tooth of claim 3 in which said point has a sloped internal surface for engagement with said tang.

5. The tooth of claim 2 in which said spring is equipped with flanges at the ends thereof, said point being equipped with recess means to accommodate said flanges.

* * * * *